US005569972A

United States Patent [19]

Lange

[11] Patent Number: 5,569,972

[45] Date of Patent: Oct. 29, 1996

[54] GAS-FILLED LIGHTNING ARRESTER HAVING COPPER ELECTRODES

[75] Inventor: Gerhard Lange, Berlin, Germany

[73] Assignee: Siemens Aktiengesellschaft, Munich, Germany

[21] Appl. No.: 290,274

[22] Filed: Aug. 15, 1994

[30] Foreign Application Priority Data

Aug. 31, 1993 [DE] Germany ..... 43 30 178.9

[51] Int. Cl.[6] ..... H01J 17/02

[52] U.S. Cl. ..... 313/231.11; 361/120; 361/118

[58] Field of Search ..... 313/231.11, 231.01; 361/120, 118, 129

[56] References Cited

U.S. PATENT DOCUMENTS

| | | | |
|---|---|---|---|
| 3,755,715 | 8/1973 | Klayum et al. | 361/120 |
| 4,266,260 | 5/1981 | Lange et al. | 361/120 |
| 4,433,354 | 2/1984 | Lange et al. | 361/120 |
| 4,866,563 | 9/1989 | Howard et al. | 361/124 |
| 4,984,125 | 1/1991 | Uwano | 361/124 |
| 5,336,970 | 8/1994 | Einbinder | 313/231.11 |
| 5,388,023 | 2/1995 | Boy et al. . | |

FOREIGN PATENT DOCUMENTS 4318366 5/1993 Germany .

*Primary Examiner*—Sandra L. O'Shea
*Assistant Examiner*—Matthew J. Esserman
*Attorney, Agent, or Firm*—Kenyon & Kenyon

[57] ABSTRACT

To achieve a contact with copper electrodes that discharges axially to a slight degree and is especially favorable from a manufacturing standpoint, a gas-filled lightning arrester with a ceramic insulator and copper electrodes is provided having a contact ring which is soldered endwise on an edge of each bowl-shaped copper electrode. The height (h) of the ring is greater than the thickness (D) of the edge of the copper electrode. The contact ring is made of iron or a magnetic, stainless alloy with a coefficient of thermal expansion $\alpha=120'10^{-7}/°C$.

10 Claims, 2 Drawing Sheets

GAS-FILLED LIGHTNING ARRESTER HAVING COPPER ELECTRODES

BACKGROUND OF INVENTION

The present invention relates to electrical components, and more particularly the structural design of the connections of lightning arresters having bowl-shaped electrodes which are soldered to a tubular ceramic insulator.

In gas-filled lightning arresters having bowl-shaped copper electrodes, the use of copper as the electrode material offers the advantages of small dimensions and high current carrying capacity. The electrodes can be manufactured by an extrusion or embossing method. Because of the considerable differences in coefficients of thermal expansion of copper and ceramic, the electrodes have a wall thickness of less than 0.6 mm in the vicinity of the soldered connections with the ceramic insulator. Thermal stresses can therefore be compensated by the plastic deformability of the copper. Connection of copper electrodes in the axial direction is either performed positively by the edge provided for soldering with the ceramic insulator or integrally by connecting wires welded to a stub in the rear bottom area of the electrode surface itself (as seen in U.S. Pat. No. 4,266,260, and U.S. Pat. No. 4,433,354). Connecting wires soldered in this way can also be bent radially (as seen in U.S. Pat. No. 4,866,563). Radial connection of connecting wires requires a certain amount of space in the axial direction that is not always available when lightning arresters are mounted in electronic equipment. In these cases, axial contacts cannot be used. This type of electrode contact likewise cannot be used when the electrodes are fitted axially with an auxiliary device such as an overload protector. In these cases the electrodes can be provided with radially welded connecting wires, provided the electrode edge has sufficient wall thickness, as is usual in electrodes made of an iron alloy otherwise conventionally used for this purpose (see U.S. Pat. No. 4,984,125).

As shown in German Patent Application No. P 43 18 366.2, a terminal is connected integrally, endwise with the soldering edge of a copper electrode; the terminal has the shape of a ring in this area. The ring and the radially projecting connecting wire are made integral. The ring simultaneously serves to center an additional cylindrical component.

In a gas-filled lightning arrester having two bowl-shaped copper electrodes soldered by their edges endwise on a tubular ceramic insulator, there is a need for a contact on the copper electrode that discharges axially to the smallest degree possible and can be readily manufactured.

SUMMARY OF THE INVENTION

This and other needs are met by the lightning arrester of the present invention. The edge of each copper electrode is provided endwise with a contact ring made of a weldable material having a coefficient of thermal expansion of approximately $120\times10^{-7}$/°C. The contact ring has a height greater than the wall thickness of the copper electrode, and the contact ring is soldered to the edge of the copper electrode. Also, a connecting wire is welded to the outer jacket surface of the contact ring.

With such a design of the lightning arrester, a radial contact is provided axially in a very limited space by connecting wires that are soldered tangentially or radially. The use of a contact ring with a coefficient of thermal expansion of approximately $120\times10^{-7}$/°C. results in a reduction of the shear stress on the soldered connection between the copper electrode and the ceramic part because the coefficient of thermal expansion of the contact ring is between the coefficients of thermal expansion of ceramic (i.e., $75\times10^{-7}$/°C.) and copper (i.e., approximately $170\times10^{-7}$/°C.) and thus partially takes up the shrinkage stresses of the copper electrode in the marginal area. Consequently, alloys containing iron are preferred for the contact ring, however pure nickel and iron can also be used. Reduction of shear stress in the area of the soldered connection between the copper electrode and ceramic insulator results in a higher electrical and, hence, thermal loading capacity of the lightning arrester. A connecting wire is welded to a special contact ring initially in the course of the manufacturing process of the lightning arrester. The use of this special contact ring offers advantages from a manufacturing standpoint in that only lightning arresters provided with contact rings can be subjected to manufacturing processes such as drum grinding, pickling, silverplating or tinplating, printing, and shaping without interference from existing wire connections. Silver is advantageously used for soldering the contact ring to the edge of the copper electrode. The silver is applied to the contact ring galvanically with a layer thickness of about 5 microns. At the soldering temperature of the lightning arrester, this silver layer forms a soldered connection with the surface layer of the edge of the copper electrode in the vicinity of the eutectic point. In this manner, it is assured that soldering of the contact ring and the copper electrode can be performed simultaneously with the soldering of the copper electrode and the ceramic insulator.

The contact ring of the present invention can be made from a round wire. A shaped wire can also be used having a cross section, which differs from a circular shape, that is flattened in the area of contact with the copper electrode, and is also flattened on the outer jacket surface, and is tapered in a dome shape at the inner jacket surface. Large connecting areas are available in the area of the integral connection, while the dome-shaped taper can serve to center an additional component. It is advantageous, if the contact ring is made of a stamped preform with an approximately rectangular cross section. By drum grinding, therefore, chamfers can be formed in the edges of the ring that ensure that a welded seam is formed that is not applied radially in the area of the contact surface with the edge of the copper electrode. A stamped contact ring can also be designed so that its cross section has a flat conical taper on the inner surface.

With the connecting wires welded onto a gas-filled lightning arrester, the connecting wires having a wire diameter of 1 mm, the height of the contact ring is advantageously about 0.8 to 1 mm. Material for the contact ring can be magnetic, stainless steels having a coefficient of thermal expansion of approximately $120\times10^{-7}$/°C., in particular, a steel of type X8Cr17 or alloy N42, as well as the material known as Vacon conventionally used for vacuum purposes (which is made of a cobalt-nickel-steel alloy).

DETAILED DESCRIPTION

Figure 1:
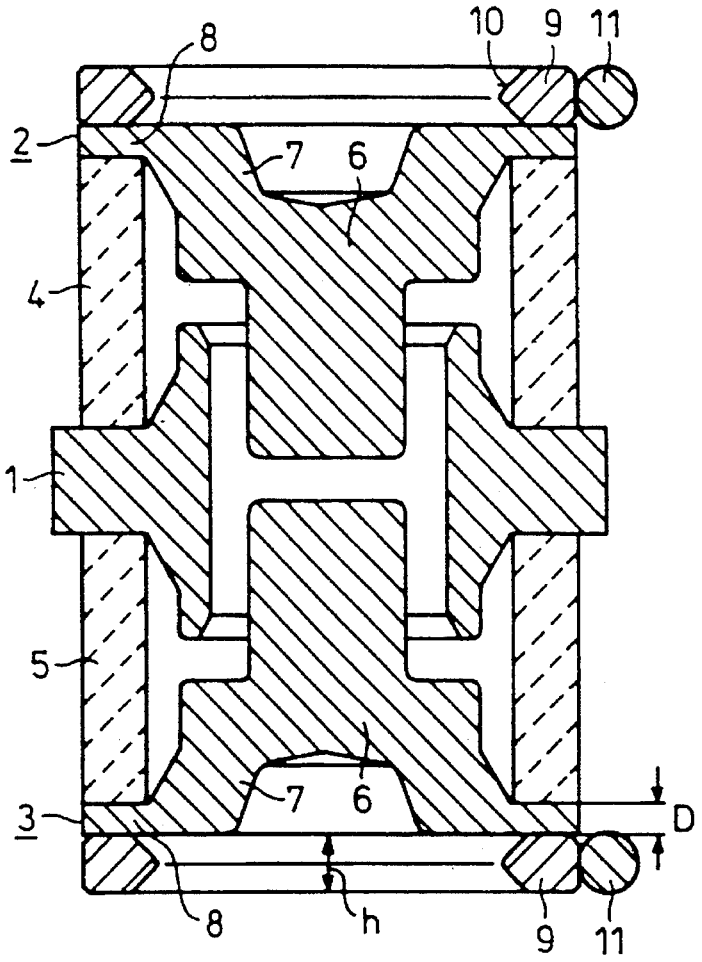
FIG. 1 is a cross-sectional diagram of a three-electrode lightning arrester having contact rings mounted on the end electrodes, where the rings are made of a shaped wire, and a welded connecting wire.

Referring to FIG. 1, a cross-section of a gas-filled three-electrode lightning arrester is shown having a central electrode 1, two end electrodes 2 and 3, and tubular ceramic insulators 4 and 5. Each of the two end electrodes 2 and 3 is bowl-shaped and has a thick bottom 6, a side wall 7, and a thin rim or edge 8. Edge 8 has a wall thickness of about 0.5 mm. The two end electrodes 2 and 3 are soldered endwise by their edges 8 to ceramic insulators 4 and 5, respectively. Electrodes 2 and 3 are made of copper and are produced by extrusion in a known manner.

A contact ring 9 comprising a magnetic stainless iron alloy with a coefficient of thermal expansion of about $120\times10^{-7}/°C.$ is soldered on the edge 8 of each electrode 2 or 3. Each contact ring 9 has a silver coating 10, which melts during the soldering process and forms a silver-copper alloy with the superficial copper layer at edge 8. The height, h, of each contact ring is greater than the wall thickness, D, of the edge 8 and is about 0.8 to 1 mm. A connecting wire 11 is welded tangentially to the contact ring 9. The connecting wire 11 is made of copper and is tinned or silvered. The contact rings 9 are each made of a shaped wire formed into a-ring. The shape of this wire is chosen so that the contact surface with the edge 8 and the outer jacket surface are made essentially flat, while the inner jacket surface is tapered like a dome arrester, the central electrode 1 has been removed, and the tubular ceramic insulators 4, 5 have been replaced by a single tubular ceramic insulator 45 coupled between the two end electrodes 2, 3.

Figure 2:
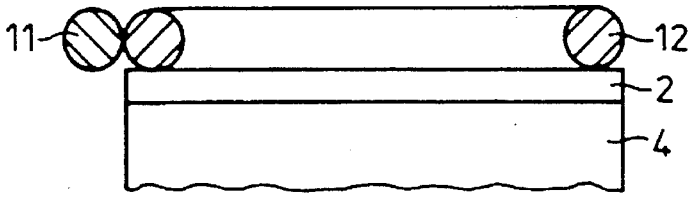
FIG. 2 is a cross-sectional diagram of a contact ring made of a round wire having a connecting wire welded thereon.
Figure 3:
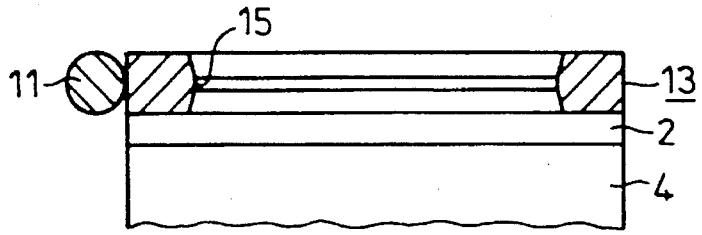
FIGS. 3 and 4 are cross-sectional diagrams of stamped contact rings having welded connecting wires.
Figure 4:
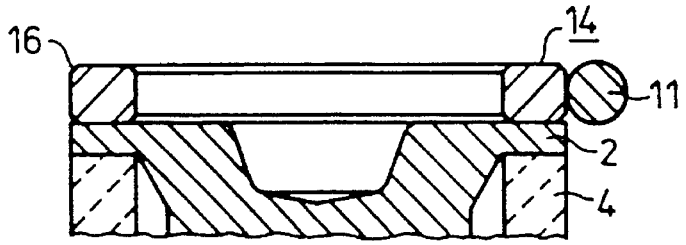
Figure 5:
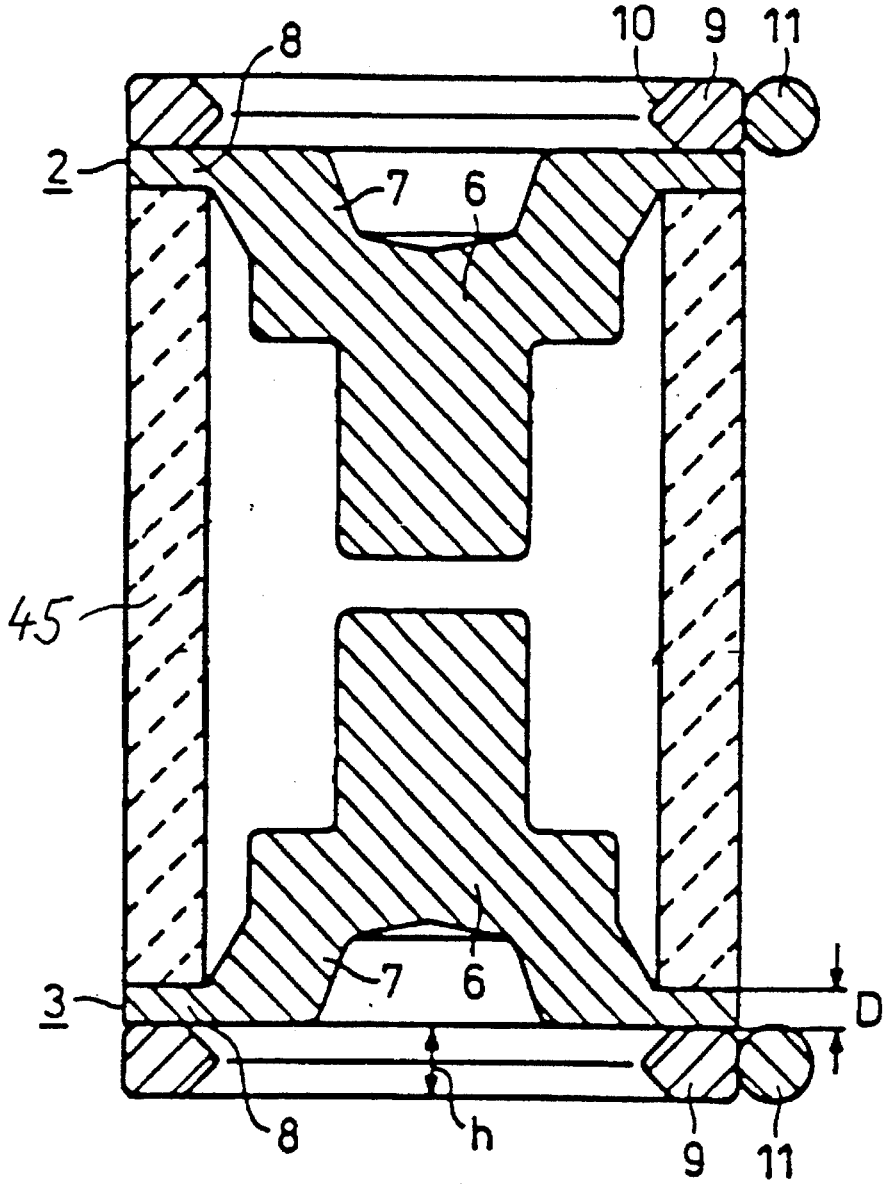
FIG. 5 is a cross-sectional diagram of a two-electrode lightning arrester having contact rings mounted on the end electrodes and having a single insulator.

Referring to FIG. 5, a cross-sectional diagram of a two-electrode lightning arrester, is shown similar to the one shown in FIG. 1. In this lightning Referring to FIG. 2, the contact ring can be made of a round wire 12. As seen in FIG. 3, the contact ring 13 can be made of a stamped part with a flat design for the contact surface, the covering surface, and the outer jacket surface. The inner jacket surface has a flat conical taper 15. As seen in FIG. 4, the contact ring 14 can be made of a stamped part with a rectangular cross section, with chamfers 16 formed at the edges by drum grinding. With the gas-filled lightning arrester of the present invention, a contact on the copper electrode discharges axially to the smallest degree possible and can be readily manufactured.

What is claimed is:

1. A gas-filled lightning arrester comprising:

at least one tubular ceramic insulator;

two bowl-shaped copper electrodes, each soldered by their edges endwise on an end of the at least one tubular ceramic insulator, where each edge of said electrodes has a wall thickness (D) of less than 0.6 mm;

a contact ring coupled endwise to each of said copper electrodes and made of a material capable of being welded and having a coefficient of thermal expansion of approximately $120\times10^{-7}/°C.$, each contact ring having a height (h) greater than the wall thickness (D) of each of said edges of said copper electrodes, where each contact ring is soldered to one of said edges of said copper electrodes; and a connecting wire welded to an outside surface of each of said contact rings.

2. The lightning arrester of claim 1, wherein each contact ring is made of nickel.

3. The lightning arrester of claim 1, wherein each contact ring is made of iron.

4. The lightning arrester of claim 1, wherein each contact ring is made of iron alloy.

5. The lightning arrester of claim 1, wherein each contact ring is made of a wire having a round cross-section.

6. The lightning arrester of claim 1, wherein each contact ring is made of a shaped wire having a first flattened surface in a vicinity of a contact surface of each copper electrode, a second flattened surface at an outer surface opposite said first flattened surface, and a tapered dome-shaped surface at an inner region of each contact ring.

7. The lightning arrester of claim 1, wherein each contact ring is made of a stamped preform with an approximately rectangular cross-section.

8. The lightning arrester of claim 7, wherein said cross-section of each contact ring has a flat conical taper at an inner jacket surface.

9. The lightning arrester of claim 1, wherein said height (h) of each contact ring is between 0.8 and 1 mm.

10. The lightning arrester of claim 1, wherein each contact ring has a galvanically applied silver layer having a thickness of approximately 5 microns.

* * * * *